United States Patent [19]

Pons

[11] Patent Number: 4,478,035

[45] Date of Patent: Oct. 23, 1984

[54] BROKEN END PIECING UP APPARATUS FOR RING SPINNING FRAMES

[76] Inventor: Roberto E. Pons, Ronda General Mitre, 105,4°, 1ª, Barcelona (6), Spain

[21] Appl. No.: 358,803

[22] Filed: Mar. 16, 1982

[30] Foreign Application Priority Data

Mar. 21, 1981 [ES] Spain ..... 500590

[51] Int. Cl.³ ..... D01H 15/00

[52] U.S. Cl. ..... 57/262; 57/88

[58] Field of Search ..... 57/261, 263, 262, 75, 57/88, 22

[56] References Cited

U.S. PATENT DOCUMENTS

| | | | |
|---|---|---|---|
| 3,546,870 | 12/1970 | Schewe et al. | 57/262 |
| 3,673,780 | 7/1972 | Merck | 57/261 |
| 3,905,187 | 9/1975 | Harmon et al. | 57/262 |
| 3,992,864 | 11/1976 | Igel | 57/262 |

*Primary Examiner*—John Petrakes

*Attorney, Agent, or Firm*—Young & Thompson

[57] ABSTRACT

A broken end piecing up apparatus for ring spinning frames having a servicing assembly propelled along the spinning frame. This servicing assembly comprises a pressurized housing which contains the mechanisms. An optical scanner is provided for detecting the absence of yarn on the corresponding bobbin and provision is made for positioning the apparatus in front of the spindle where the absence of yarn has been detected. The apparatus has a mechanism which then stops the broken end spindle and rotates it in the unwinding direction, withdrawing and picking up this broken end from the bobbin. Then a predetermined length of yarn is pulled out from this bobbin and fed through the corresponding ring traveller. The broken end is cut, combed and fed to the roving issuing from the drafting systems and the piecing up operation of both takes place. Then the servicing assembly moves on to detect a further absence of yarn.

7 Claims, 10 Drawing Figures

BROKEN END PIECING UP APPARATUS FOR RING SPINNING FRAMES

This invention relates to an end piecing apparatus for ring spinning frames, for reducing or eliminating the labor normally assigned to the spinners, bearing in mind that this represents a high percentage of the manufacturing costs.

Experience and innovations in the art have made possible the development of the apparatus of the invention which is characterized in that, being contained in a pressurized housing, it comprises in combination:

(a) an optical scanner for detecting the absence of yarn between the frame drafting system and the spindle;

(b) means for positioning the piecing up apparatus in the required place for piecing up the yarn;

(c) a member capable of braking or stopping the broken end spindle and rotating it in the unwinding direction;

(d) a member for withdrawing the broken end from the bobbin;

(e) means for picking up the broken end from the bobbin;

(f) means for detecting a length of yarn from the bobbin, at the same time as it brakes the corresponding spindle;

(g) a member for feeding the broken end from the bobbin through the corresponding ring traveller;

(h) a member for cutting, combing and feeding the broken end from the bobbin to the issuing roving from the drafting system and piecing them up; and (i) a member for supplying an additional yarn to the bobbin in cases where there is no yarn because the bobbin is empty or the yarn is inaccessible to the yarn withdrawing member.

The apparatus of the invention is also characterized in that the optical scanner for detecting the absence of yarn comprises essentially a light-emitting device and a light-sensitive element which signals said absence.

The apparatus of the invention is also characterized in that the means for placing the piecing-up apparatus in the ends down position comprises a braking and positioning device adapted to slide along vertical guide rails for movement of the piecing-up apparatus to the suitable height and on further horizontal guide rails to accurately locate the piecing-up elements, the movements along the vertical and horizontal guide rails being powered by respective geared motors.

The apparatus of the invention is further characterized in that the member for rotating the broken end spindle in the opposite direction, comprises a geared motor mounted on a hinged arm rocking under the effect of an electromagnet, there being attached to said geared motor a pulley supporting plate for a reversing band driven by a pulley mounted on the motor shaft and applied to the periphery of the spindle to be braked, forcing it to rotate in the opposite direction when the geared motor is set running.

A further feature of the invention is that the member for withdrawing the broken end from the bobbin comprises an aspirator unit which sucks in the broken yarn end with a flexible tube and nozzle.

In accordance with the above feature, the picking up of the broken end is effected with the aid of a beater means connected to a geared motor located at the end of a rocker arm, the blades of which raise the yarn end to facilitate the aspiration, said blades applying always the same pressure to the bobbin. The static electricity produced by the friction of the blades is eliminated by a static eliminator rod.

In combination with the aspirator unit's action, the pertinent tube is provided with a piezoelectric sensor indicating that the length of yarn required for piecing up has been obtained.

A further feature of the invention is that the member for feeding the broken end through the ring traveller comprises a threading tape wound in a store and movable by rollers for insertion in said traveller with the aid of a head mounted on the end of the tape.

Yet a further feature of the invention is a movable member capable of moving towards or away from the bobbin, carrying an auxiliary yarn to be wound thereon and to act as yarn therefrom if there is no yarn or it is inaccessible.

A final feature of the invention is that the member for cutting and moving the bobbin yarn end towards the roving issuing from the drafting system comprises a piecing-up device formed by a rotary arm having a fixed portion having a cutting edge mating with a further cutting edge on a rocking portion, said rocking portion having a toothed portion to nip the yarn, there being also a blowing tube for correctly orientating the fibers of the yarn end for the piecing operation. The whole assembly is provided with a sideways movement in the direction of the axis of rotation thereof, to line up at any time, the issuing roving with the yarn to which it is to be pieced up, following information provided by the funnel holder bar.

Further features and advantages of the invention will be disclosed in detail in the following description, with reference to the accompanying illustrative drawings, in which.

Figure 1:
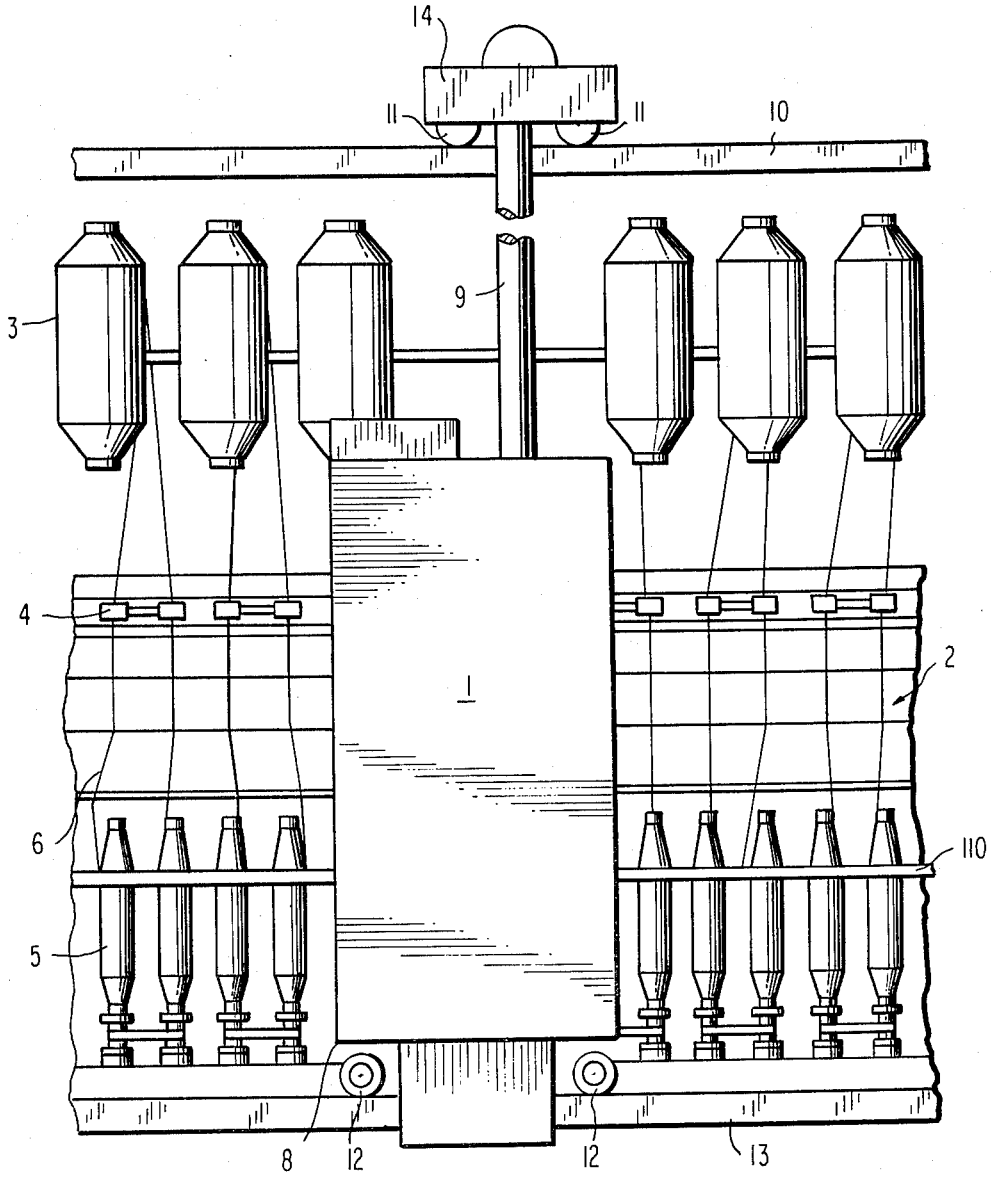
FIG. 1 is an elevation view of the apparatus of the invention mounted on a ring spinning frame.

The apparatus of the invention is mounted on a ring spinning frame 2 having roving packages 3, drafting system 4 and spindles 5 for the yarn 6, together with the pertinent yarn guides and drive means for the spindles 5.

The apparatus 1 is provided with a housing formed by upper and lower platforms *7a* and *7b*, casing 8 which is suspended by means of a bar 9 from the upper rail 10, with wheels 11 therefor, together with lower wheels 12 running on a lower rail 13. The upper wheels 11 are moved by drive means 14. The casing is pressurized inside to prevent the ingress of dust.

Figure 2:
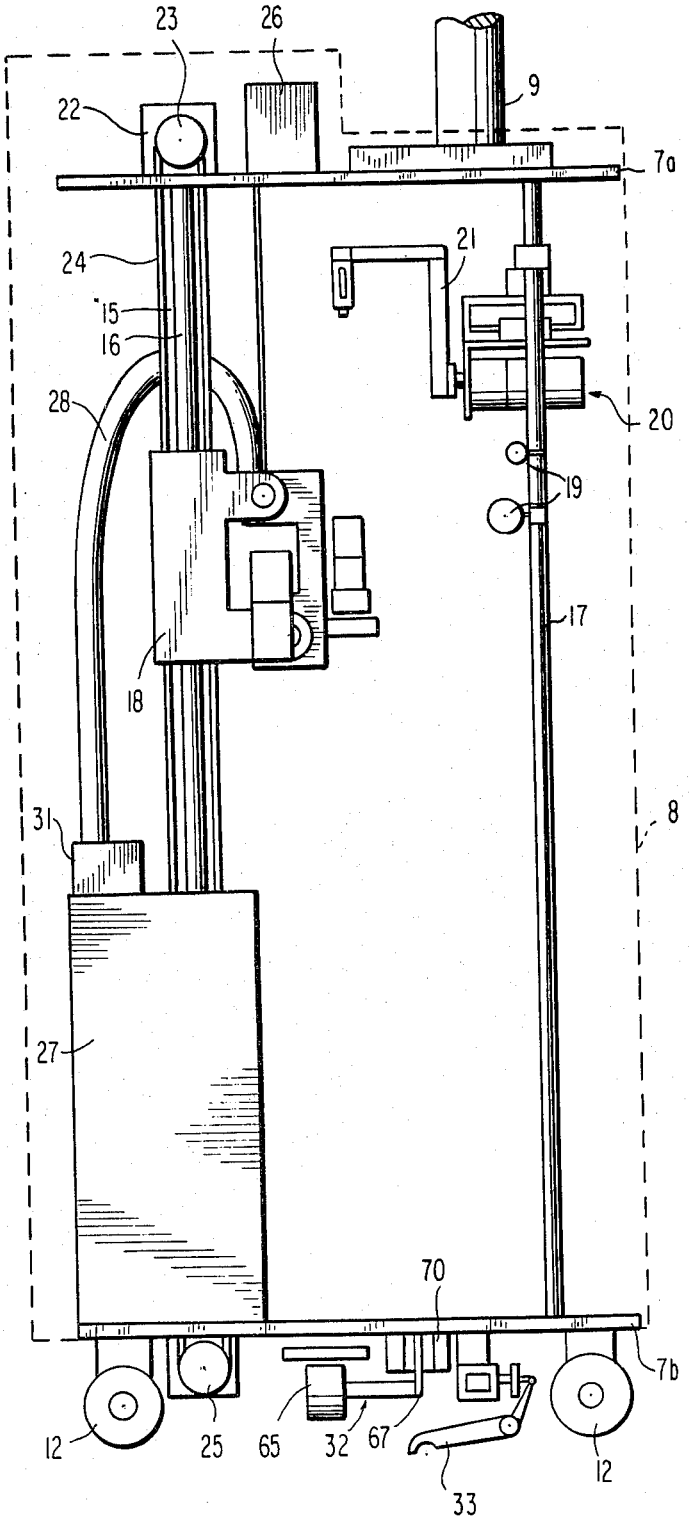
FIG. 2 shows the apparatus of FIG. 1 after removal of the casing.
Figure 3:
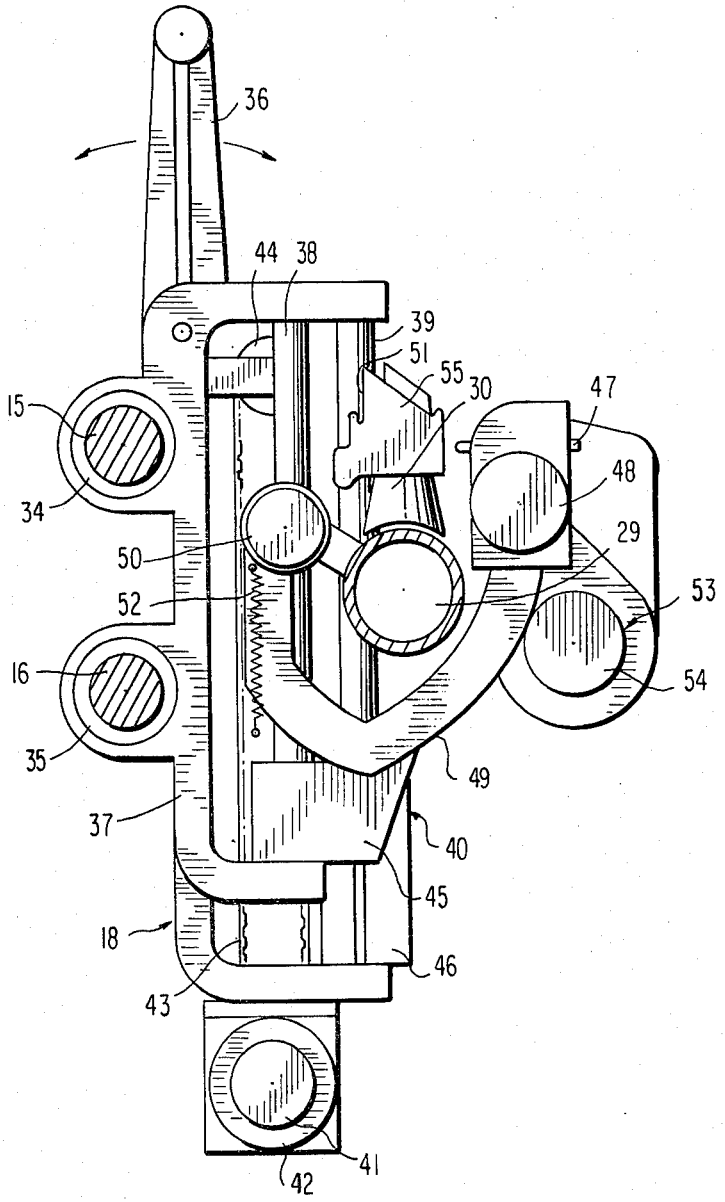
FIG. 3 is a plan view of the moving parts of the apparatus of the invention.

The platforms *7a* and *7b* are connected together by stringers 15, 16 and 17, serving as guide for the mobile vertical unit 18 and to hold an optical sensor 19 and the piecing-up device 20 as shown in FIG. 2 and the piecing-up device 20 carries a piecing-up arm 21.

The upper platform *7a* supports a geared motor 22 with toothed pulley 23 for a toothed belt 24 coupled to a further lower pulley 25 for movement of the mobile unit 18. A compensator means 26 counteracts the weight of said moving unit 18 to prevent stresses on the spinning frame ring rail.

The lower platform 7b supports the aspiration means 27 which connects by means of a flexible tube 28 with a tube 29 carrying a suction nozzle 30, there being a piezoelectric sensor 31 in the tube 28. The means 27 also produces the pressurization of the apparatus 1. Also mounted on the lower platform 7b is a mechanism 32 for driving a reversing tape and braking and holding means 33.

The moving unit 18 is provided with bearings 34 and 35 around the bars 15 and 16 and a stop 36 bearing on the ring rail of the frame 2 and is capable of rocking horizontally to allow for passage of the machine through the ends of the spinning frame. The frame 37 of said unit is provided with horizontal guides 38 and 30 for movement of a further horizontally moving unit 40 provided with movement from a geared motor 41 having a toothed pulley 42 meshing with a toothed pulley 43 coupled to a further toothed pulley 44. Bearings 45 and 46 allow the movement of unit 40 along the guides 38 and 39.

The moving unit 40 is provided with a shaft 50 on which the arm 49 may rock, there being at the end thereof the geared motor 48 driving the beater 47. Adjacent the aspiration nozzle 30 there is a static electricity suppressor bar 51 for clearing static electricity from the bobbin yarn. A spring 52 provides the necessary pressure for the blades 47 to press properly against the bobbin. On the nozzle 30 there is a threading device 53 provided with geared motor 54 and a tape guide member 55.

Figure 4:
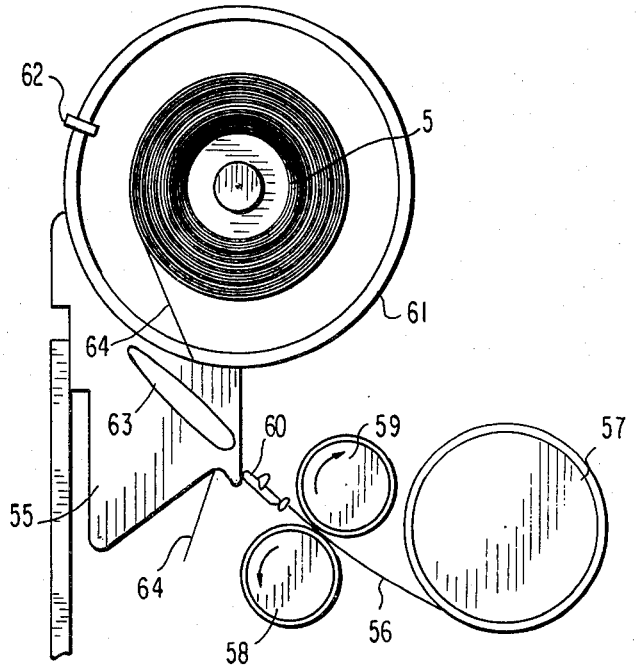
FIGS. 4 and 5 show two operative stages of the threading tape of the piecing-up apparatus.
Figure 5:
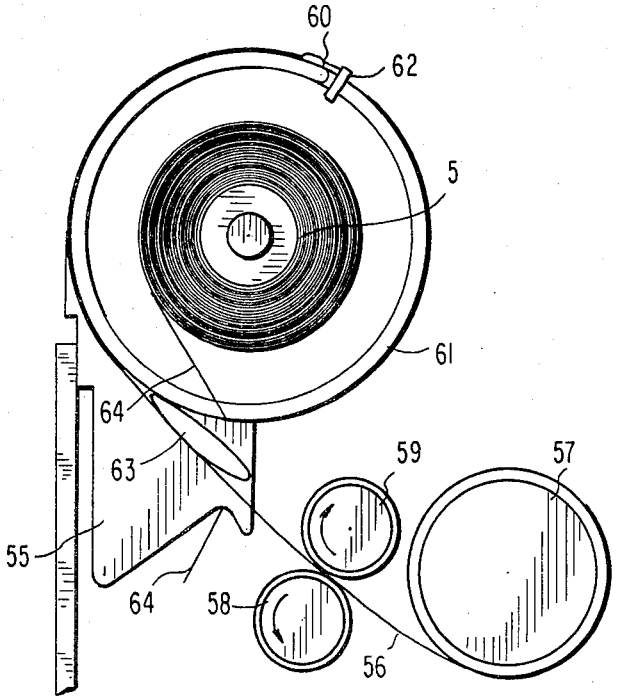

FIGS. 4 and 5 are details of the threading device 53 which comprises a threading tape 56 stored in a store 57 and driven by rollers 58 and 59 and provided with a head 60. A spindle 5 is illustrated with its ring 61 and a traveller 62. A guide member 63 prevents the tape 56 from engaging the ring 61 at an incorrect angle, while the tape guide member 55 holds the yarn 64.

Figure 6:
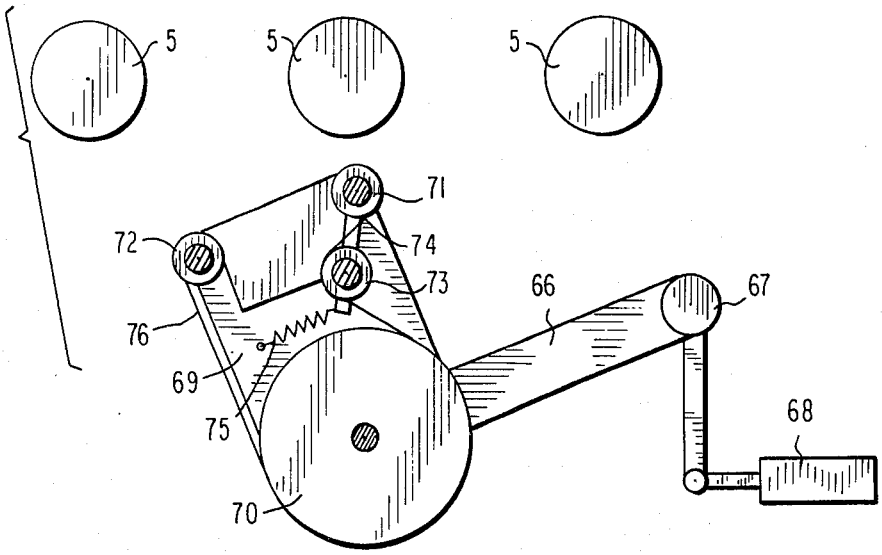
FIGS. 6 and 7 show two operative stages of the reversing band of the apparatus of the invention.
Figure 7:
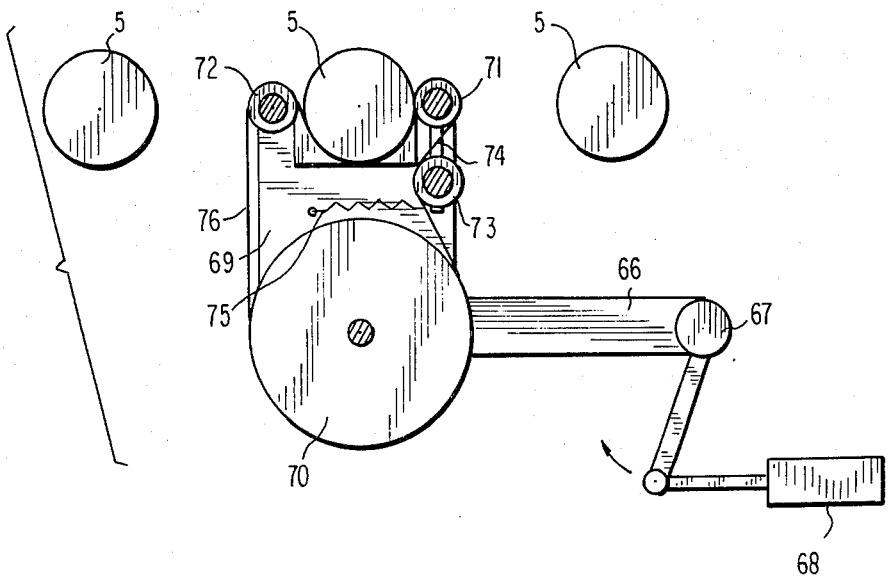

The mechanism 32 illustrated in FIG. 2 is for rotating the spindle 5 in the opposite direction and comprises a geared motor 65 mounted on an arm 66 pivoted to the shaft 67 and which is rocked by means of an electromagnet 68 as illustrated in FIGS. 6 and 7. To the geared motor 65 there is attached a plate 69 and a pulley 70 is attached to the shaft thereof, there being attached to said plate 69 the shafts of pulleys 71 and 72 and a tensioning pulley 73 by an arm 74 and a spring 75, while an endless band 76 is trained around the pulleys.

Figure 8:
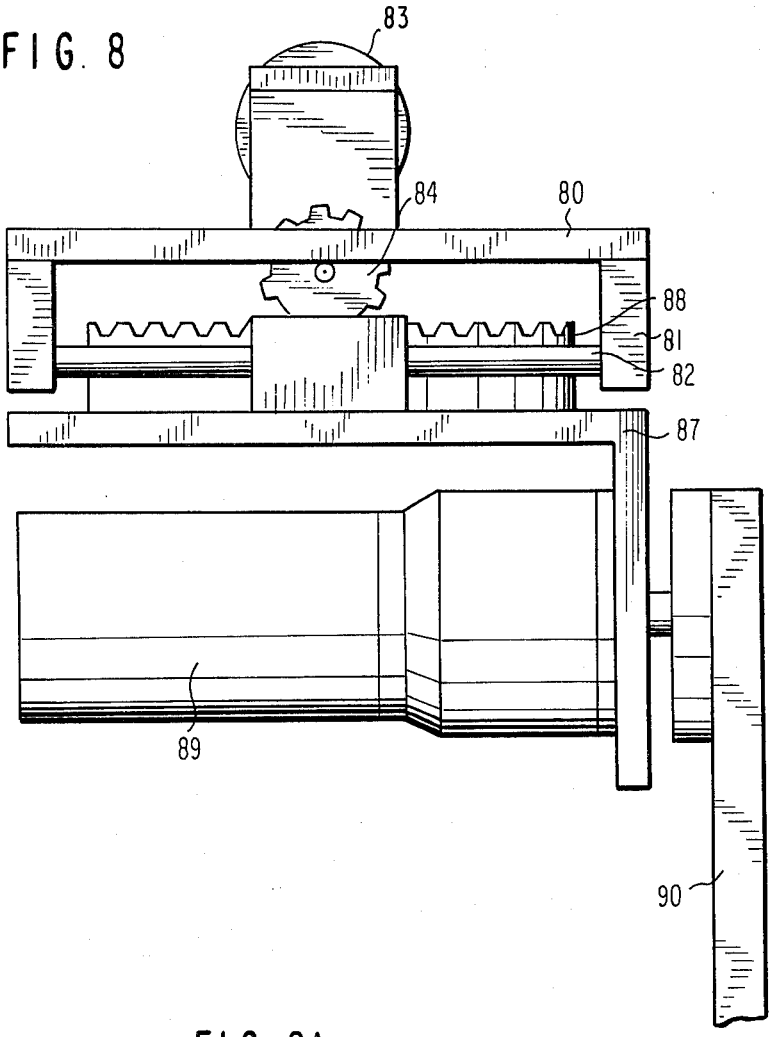
FIG. 8 shows the lateral drive device for the apparatus piecing-up arm.

On the bar 17 of the apparatus there is mounted the piecing-up device drive mechanism, there being a support 80 connected to said bar 17 with guides 81 and 82 and a geared motor 83, the shaft thereof carrying a sprocket wheel 84 as shown in FIG. 8. Bearings run along the guides 81 and 82 and are attached to an angle member 87 which mounts a rack 88 meshed with the sprocket 84 and a geared motor 89. The piecing-up arm 90 is coupled to the shaft of the geared motor 89.

Figure 9:
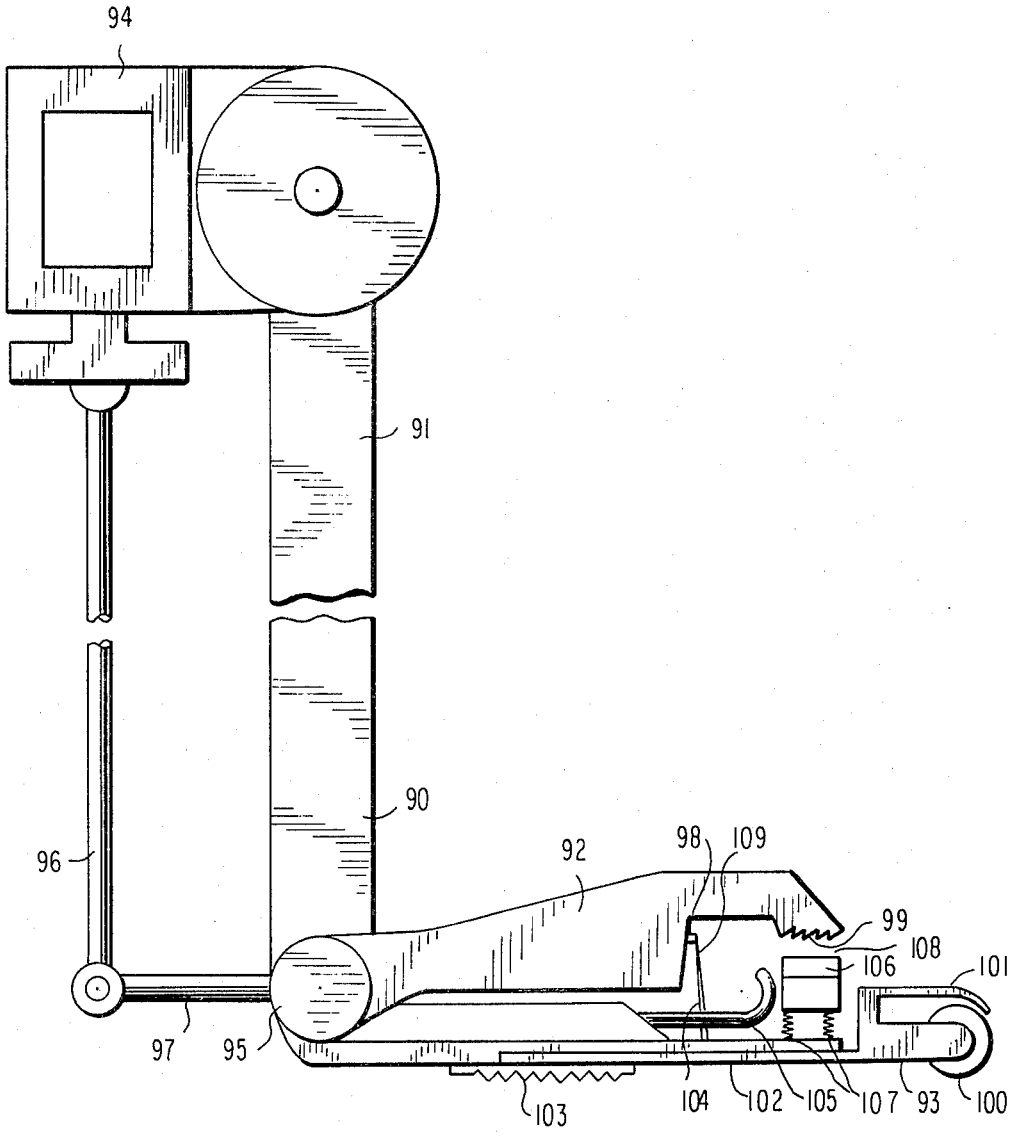
FIG. 9 is a side view of the piecing-up arm.

The piecing-up device illustrated in FIG. 9 comprises a fixed portion 91 attached to the shaft of the geared motor 89, a rocking portion 92 and a folding portion 93. The fixed portion 91 is provided with an arm 90 and an electromagnet 94. The rocking portion 92 rocks around a shaft 95 and serves to cut and press, being moved by the electromagnet 94 through a connecting rod 96 and a crank 97. Rocking portion 92 has a cutting edge 98 and a toothed portion 99. Folding portion 93 is provided with a roller 100 and a yarn guide 101, an arm 102 pulled by a spring 103, a cutting edge 104, a blow tube 105 and a rubber stop 106 mounted on springs 107. Nipping and cutting points 108 and 109 are marked between which there acts the blow tube 105 to make parallel the cut roving fibers from the point of retention thereof.

The device in question operates as follows. The apparatus 1 patrols the spinning frame 2 on the support and travelling means described hereinabove while the optical sensor 19 scans the yarns 6 to locate any ends down situation, such that when any is detected the apparatus is braked and stopped by the pawl of device 33 which engages a bolt corresponding to the affected spindle 5, whereby a microswitch stops the movement of the apparatus and sets the repair devices in motion. In the first place the electromagnet 68 moves the reversing band 76 to apply it to the spindle and brake it, and the spindle is then forced to rotate in a reverse direction by the band 76. At the same time, the motor 23 is set running to move the moving unit 18 vertically until the ring rail 110 is located. It is stopped at this point and thereafter the horizontally movable part of the unit is moved to approach the package on the spindle in question and stops in this place when the blades 47 engage the package. At this time the threading tape 56 reciprocates briefly to locate the ring traveller 62 in the right position for threading, while the blades 47 press the spindle against the force of the spring 52.

The aspiration of the nozzle 30 on the package, together with the action of the blades 47 lift the broken end, with the aid of the reverse rotation of the spindle and the anti-static bar 51, whereby the broken end penetrates the tube 29 until it encounters the sensor 31, when the beater 47 and the bobbin rotation stop, at which time the aspiration is reduced to a minimum to keep the yarn sufficiently tensioned, while the moving unit 18 is withdrawn to be able to locate the tape guide 55.

The threading tape 56 is then set moving and passes between the guides 55 and 63 and slides along the periphery of the ring 61 pulling the traveller 62 from the position where it is to the point of threading with the traveller. At this point there is operated a microswitch which reverses the direction of rotation of the motor 54 to recoil the tape 56 on the store 57, when a further microswitch stops said motor and sets the motor for horizontal movement of the moving unit to the starting point, after which a further microswitch causes vertical movement of the moving unit to the initial upper position, at which time the yarn aspirated by the nozzle 30 and threaded through the traveller 62 slides and is sufficiently tensioned from the bobbin, penetrating in the yarn guide of the moving unit to ensure the exact position where the yarn should be picked up by the piecing-up arm 90, which starts moving when the moving unit stops, picking up the yarn with a forward movement to locate the yarn in nipping point 106, the piecing-up arm 90 rotating until it approaches the drafting system where a microswitch stops it and operates the nipper 92, cutting the excess yarn which is taken up by the aspirator 27.

As the nipper 92 closes, the electromagnet 68 is deenergized, the reversing tape 76 being withdrawn from the base of the spindle 5, which rotates in its normal direction, twisting the yarn for a period of time depending on the position of the ring rail 110 and according to information provided by the frame 2. Thereafter the piecing-up arm 90 is ordered by the frame 2 to resume its operation, whereupon it approaches the drafting system to contact the roving therein with the yarn nipped by the arm 90, the magnet 94 which closed the nipper being de-energized, whereby the roving and the yarn are united, production of yarn to repair the break being initiated. After the preset contact time, a microswitch reverses the direction of rotation of the motor 89 moving the arm 90, which withdraws to the starting position thereof. This arm 90 is also provided, in addition to the rotation thereof, with a transverse movement of the assembly so that the existing roving may coincide with the yarn end to be pieced up, due to the motor 83 through the pinion 84 and rack 88, which movement takes place when the arm 90 has picked up the yarn by the nipper 92 and twists said yarn. This movement is reversed when piecing-up is finished.

The motor 83 receives information from the frame 2 as to the exact position of the fed roving and, therefore, it moves sufficiently for the ends to be pieced-up to meet, for which purpose the guide bar is provided with the rack 88 meshing with the pinion 84 attached to the shaft of a geared motor 83, electrically controlled for the instantaneous positioning of the trumpet holder bar.

When the piecing-up arm 90 reaches its starting position, it operates a microswitch which stops the motor 89, de-energizes the electromagnet of the holding device 33 and the trip of this device lifts, whereby the corresponding microswitch ceases to operate. This sets the motor 14 running to drive the apparatus 1 which continues its patrol in search of further ends down situations.

Figure 8A:
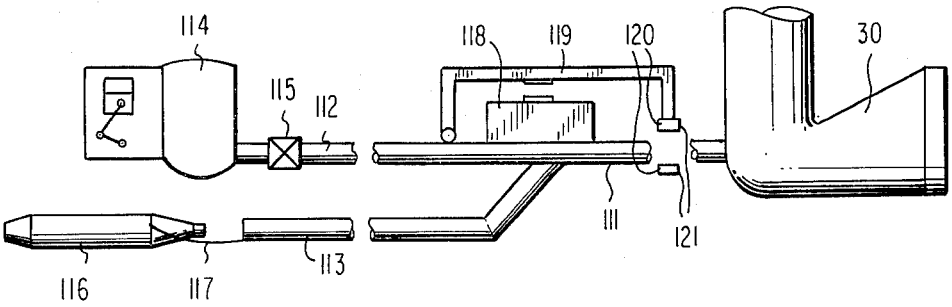
FIG. 8A shows an auxiliary yarn supplying device.

When the broken end may not be located by the pick-up unit, since it is inaccessible or non-existent, once the search time has elapsed, the auxiliary supplying device operates. One possible embodiment of this auxiliary yarn supplying device consist (FIG. 8A) in a tube 111 positioned in the rear front of the suction nozzle 30, this tube being divided in two portions 112 and 113, like a venturi tube. The portion tube 112 is connected to a compressor 114 through a corresponding valve 115 and the tube portion 113 is disposed in front of an auxiliary yarn bobbin 116.

When the valve 115 is opened, the air moving through the tube 112 carries away the yarn 117 through the portion tube 111, this yarn coming from the bobbin 116 through the tube 113. This auxiliary yarn 117 is carried away through the suction nozzle 30 and approaches the package spindle which is rotating at a low speed and consequently this yarn is wound on. When a sufficient length of yarn becomes wound on the package, the blowing action of the air through the tube 112 is stopped. At the same time the package rotation is stopped, and the tape device for threading yarn through the ring traveller is then set in motion as described hereinabove. The operations are the same as described when the broken end is obtained by the nozzle aspiration effect on the package. The only difference is when the piecing-up arm cuts the yarn, the electromagnet 118 is energized and through the member 119, the nippers 120 and the cutting edges 121, it produces the cutting action and the retention of the cut end of yarn 117 at the same time that a short aspiration effect takes place for the absorption of the yarn length residue.

The yarn 117 will remain in this position until a new feeding operation becomes required.

The microswitches comprised in the apparatus 1, as well as those mounted on the spinning frame 2, transmit the momentary or permanent pulse to a microprocessor, programmed logic control or similar unit which, following the information received, immediately sets the corresponding motor for the time, in the direction and at the speed required.

What is claimed is:

1. A broken end piecing-up apparatus for a ring spinning frame having a plurality of roving packages and a plurality of spindles for yarn with a drafting system between said packages and said spindles and means to rotate the spindles to wind the yarn on the spindles, said apparatus comprising means to move the apparatus along the ring spinning frame, means to detect the absence of yarn between said drafting system and a said spindle, means for stopping and positioning the apparatus in registry with said spindle, an endless belt, spaced pulleys about which said belt is trained, a member carried by the apparatus and on which the pulleys are mounted for rotation, means to move the member toward and away from said spindle thereby selectively to bring said belt into and out of contact with said spindle between said pulleys, means to circulate said endless belt in contact with said spindle between said pulleys first to stop and then to reverse the direction of rotation of the spindle to an unwinding direction, means for grasping the broken end of yarn from the spindle, and means for uniting said broken end with an end of yarn from said drafting system.

2. Apparatus as claimed in claim 1, in which said apparatus is contained in a pressurized housing.

3. Apparatus as claimed in claim 1, said detecting means comprising an optical scanner.

4. Apparatus as claimed in claim 1, said spinning frame having a ring rail having a ring traveller thereon, and means for threading said broken end through said ring traveller.

5. Apparatus as claimed in claim 1, and means resiliently urging one of said pulleys in a direction to tension the belt, and power means for rotating another of said pulleys to drive the belt.

6. Apparatus as claimed in claim 1, and horizontal track means on which said apparatus rolls relative to said spinning frame.

7. Apparatus as claimed in claim 6, and vertical track means on which said grasping and uniting means moves relative to said frame.

* * * * *